US010458400B2

(12) United States Patent
McLoughlin et al.

(10) Patent No.: US 10,458,400 B2
(45) Date of Patent: Oct. 29, 2019

(54) SYSTEM AND METHOD OF AUTOMATIC PUMP OPERATION

(75) Inventors: John E. McLoughlin, Hauppauge, NY (US); Neocles G. Athanasiades, E. Setauket, NY (US); Kiam Meng Toh, St. James, NY (US)

(73) Assignee: ROM Acquisition Corporation, Belton, MO (US)

( * ) Notice: Subject to any disclaimer, the term of this patent is extended or adjusted under 35 U.S.C. 154(b) by 2019 days.

(21) Appl. No.: 13/281,140

(22) Filed: Oct. 25, 2011

(65) Prior Publication Data

US 2013/0098642 A1 Apr. 25, 2013

(51) Int. Cl.

| | |
|---|---|
| ***A62C 27/00*** | (2006.01) |
| ***F04B 17/05*** | (2006.01) |
| ***F04B 49/02*** | (2006.01) |
| ***F04B 49/20*** | (2006.01) |
| ***F04B 17/06*** | (2006.01) |

(52) U.S. Cl.
CPC ..... *F04B 17/05* (2013.01); *F04B 17/06* (2013.01); *F04B 49/022* (2013.01); *F04B 49/20* (2013.01); *A62C 27/00* (2013.01)

(58) Field of Classification Search
CPC ..... A62C 27/00; F04B 49/022; F04B 49/20
USPC ..... 169/43; 417/34, 43, 63, 44.2
See application file for complete search history.

(56) References Cited

U.S. PATENT DOCUMENTS

| | | | | |
|---|---|---|---|---|
| 3,786,869 | A | 1/1974 | McLoughlin | |
| 4,189,005 | A * | 2/1980 | McLoughlin | 169/24 |
| 4,512,412 | A | 4/1985 | Campbell | |
| 5,888,051 | A | 3/1999 | McLoughlin | |
| 6,421,593 | B1 * | 7/2002 | Kempen et al. | 701/48 |
| 6,547,528 | B1 | 4/2003 | Yoshida | |
| 6,909,944 | B2 | 6/2005 | Pillar | |
| 7,572,107 | B2 * | 8/2009 | Heller et al. | 417/53 |
| 7,987,916 | B2 * | 8/2011 | Laskaris et al. | 169/24 |
| 2009/0208346 | A1 | 8/2009 | McLoughlin | |
| 2011/0064591 | A1 | 3/2011 | McLoughlin | |

OTHER PUBLICATIONS http://thumbs.dreamstime.com/thumblarge_185/1189815858kTX3z5.jpg.

* cited by examiner

*Primary Examiner* — Alexander Valvis

(74) *Attorney, Agent, or Firm* — Wei Wei Jeang; Grable Martin Fulton PLLC

(57) ABSTRACT

A system for automatically setting up a truck-mounted pump driven by an engine for pumping operation, comprising a transmission control having a visual indicator and coupled to a transmission of the truck, a pump control having a visual indicator and coupled to the pump, a prime control having a visual indicator and coupled to a prime pump, a master system control switch operable to receive operator input, and a main controller in data communication with the transmission control, pump control, prime control, and the master system control switch, the main controller receiving an input from the master system control switch to initiate pump setup operation, and automatically transmitting alert signals to the visual indicators of the transmission control, pump control, and prime control to provide visual guidance to the operator in the proper sequence of steps to set up the pump for pumping operation.

9 Claims, 3 Drawing Sheets

SYSTEM AND METHOD OF AUTOMATIC PUMP OPERATION

FIELD

The present disclosure relates to a system and method of automatic pump operation generally for firefighting applications.

BACKGROUND

Firefighting is a highly dangerous occupation that subjects firefighters to many hazards. An important asset to the firefighters is maintaining a steady and abundant water supply to suppress fire and/or filling a truck-mounted water tank. Both of these tasks are typically accomplished by using a pump on-board the fire truck and driven by the truck engine. The water from a fire hydrant is typically directly conducted to the site of the fire. In some instances, the water from the fire hydrant is used to refill a water tank while at the same time supplying water to the fire hose used to extinguish the fire. A dangerous situation occurs when delay is introduced in setting up the fire truck for pumping operation. Because of the complicated series of steps required, the pump operator may easily and inadvertently fail to carry out the steps properly and thus delay the delivery of needed water for firefighting. Such unexpected delay in supplying water to the fire hose and the water tank can be disastrous for the firefighters at the scene.

SUMMARY

A system and method of automatic pump operation generally for firefighting applications is envisioned and described herein.

A system for automatically setting up a truck-mounted pump driven by an engine for pumping operation, comprising a transmission control having a visual indicator and coupled to a transmission of the truck, a pump control having a visual indicator and coupled to the pump, a prime control having a visual indicator and coupled to a prime pump, a master system control switch operable to receive operator input, and a main controller in data communication with the transmission control, pump control, prime control, and the master system control switch, the main controller receiving an input from the master system control switch to initiate pump setup operation, and automatically transmitting alert signals to the visual indicators of the transmission control, pump control, and prime control to provide visual guidance to the operator in the proper sequence of steps to set up the pump for pumping operation.

A system for automatically setting up a truck-mounted pump driven by an engine for pumping operation, comprising an engine controller coupled to the engine of the truck, a transmission controller coupled to a transmission of the truck, a pump controller coupled to the pump, a pump pressure transducer coupled to the pump operable to measure a pump pressure, a control valve operable to regulate a water flow from the tank to a truck-mounted pump, a master system control switch operable to receive operator input, and a main controller in data communication with the transmission controller, pump controller, and the master system control switch, the main controller receiving an input from the master system control switch to initiate pump setup operations, and operable to automatically receive the pump pressure, and automatically control the engine, transmission, pump, and control valve in a proper sequence to automatically set up the pump for pumping operation.

A method for automatically setting up a truck-mounted pump driven by an engine for pumping operation, comprising receiving an operator input to initiate pump setup operations, automatically put the pump at 50% operation and wait for confirmation, automatically put the pump at 100% operation, automatically put a transmission of the truck in drive and wait for confirmation, automatically checking a pump pressure, automatically opening a control valve to permit water from a discharge outlet of the tank to flow to the pump, and automatically increasing an engine speed and a pump speed to predetermined settings to increase water flow from the pump.

A memory having stored therein computer software code executable by a computer to implement a method for automatically setting up a truck-mounted pump driven by an engine for pumping operation, comprising receiving an operator input to initiate pump setup operation, automatically issuing an alert to guide the operator to put the pump at 50% operation and waiting for confirmation, automatically issuing an alert to guide the operator to put the pump at 100% operation, automatically issuing an alert to guide the operator to put a transmission of the truck in drive and waiting for confirmation, automatically opening a control valve to permit water from a discharge outlet of the tank to flow to a pump, and automatically increasing an engine speed and a pump speed to predetermined settings to increase water flow from the pump.

DETAILED DESCRIPTION

Figure 1:
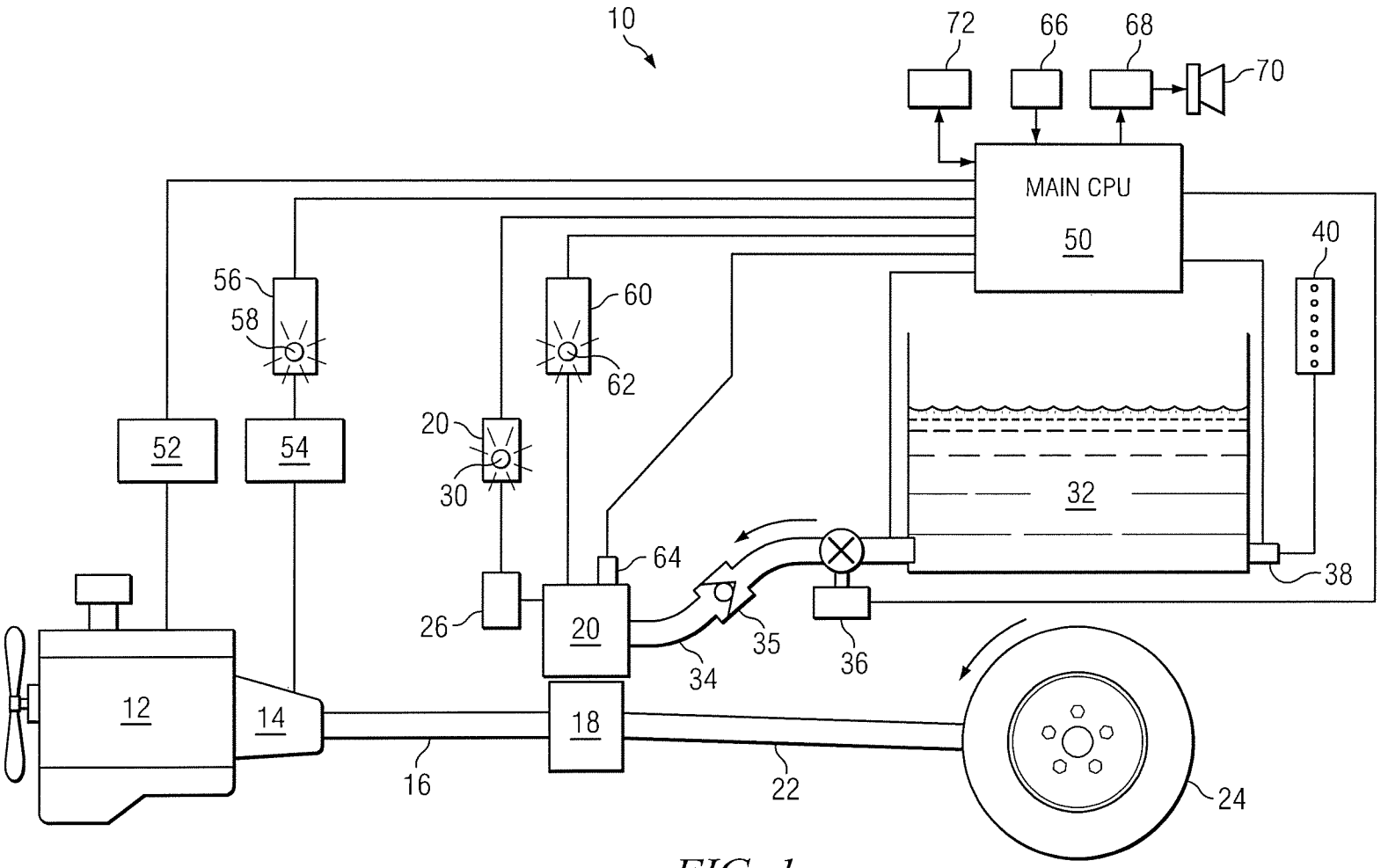
FIG. 1 is a simplified block diagram of an exemplary embodiment of a system of automatic pump operation generally for firefighting applications.

FIG. 1 is a simplified block diagram of an exemplary embodiment of a system 10 of automatic tank refill generally for firefighting applications. System 10 is shown in operation with an engine 12 of a fire truck (not shown) mechanically coupled to a transmission 14, which includes a transmission shaft 16 mechanically coupled to a transfer unit 18. The transfer unit 18 is further coupled to a pump 20 and a drive shaft 22 and drive wheels 24 of the fire truck. The transfer unit 18 is operable to divert engine power to the drive shaft 22 and drive wheels 24 to drive the pump 20.

The pump 20 is further coupled to a prime pump 26 under the control of a prime control 28. The prime control 28 may a manually-operable lever, button, switch, for example, and may further include an alert device 30, such as an LED. The pump 20 includes an inlet that is coupled to a water tank 32 via an intake pipe 34. A control valve 36 is disposed in the intake pipe 34 and is operable to control the flow of water from the tank 32 to the pump 20. The discharge outlet of the pump may also be coupled to a fire hose (not shown) used by firefighters to suppress fire. A level sensor 38 is further coupled to the water tank 32 operable to measure the amount of water or liquids in the tank and provide the data to a visual display device 40. An intake inlet (not shown) of the pump 20 may be coupled to a fluid source, such as, without limitation, a tank 32 mounted on the fire truck, a fire hydrant, a relay hose, and a draft hose. The pump intake may be coupled to another fluid source, such as a tank mounted on a tanker truck (not shown), or for example a water reservoir, pool, pond, and lake (not shown). It should be understood that there is a system of plumping components coupled to the pump 20 but is not show explicitly in FIG. 1 or described herein for the sake of clarity and brevity. A check valve 35 is disposed in the pump intake pipe 34 to regulate the direction of water flow therein.

The operations of the engine 12 is under the control of a main CPU 50 and an engine CPU 52. Further, the operations of the transmission 14 is under the control of a transmission CPU 54. A transmission control 56 is coupled to the transmission CPU 54. The transmission control 56 may include a manually-operable lever, button, switch, for example, and may further include an alert device 58, such as an LED. The pump 20 is under the control of a pump control 60, which may include a manually-operable lever, button, switch, for example, and may further include an alert device 62, such as an LED. A pressure transducer 64 is coupled to the pump 20 and operable to measure the discharge pressure of the pump. The main CPU 50 is coupled or in communications with the transmission control 56, prime control 28, and pump control. The main CPU 50 is further coupled to or in communication with the pressure transducer 64 and level sensor 38, and is operable to receive the pressure and tank level measurements periodically or upon polling.

Figure 2:
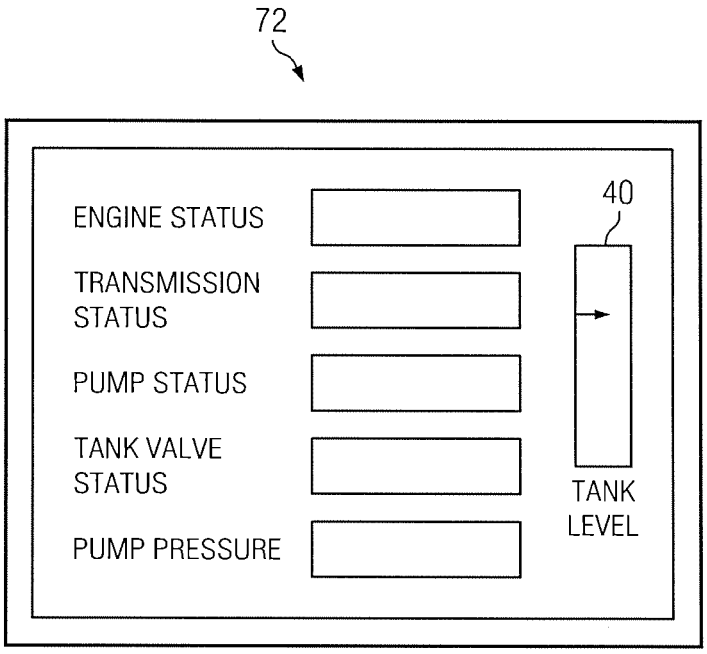
FIG. 2 is a simplified diagram illustrating an embodiment of an operation feedback panel.

A master system control switch 66 coupled to the main CPU 50 includes a manually-operable lever, button, switch, for example, to enable the operator to initiate system operations. Additionally, a voice control unit 68 and speaker system 70 may be coupled to the main CPU 50 to enable an audio interface. In one embodiment, the voice control unit 68 may generate and issue audio commands that provide instructions for each step to the operator to ensure proper pump operations. In another embodiment, the voice control unit 68 may additionally generate and issue audio alerts that provide the operator feedback on the proper or improper execution of the pump operation sequence. Further coupled to the main CPU 50 is a display panel 72 capable of presenting status and information to the operator. For example, the display panel may provide the current status of the engine, transmission, pump, and pump valve. Further, the pump discharge pressure and tank level may be displayed. An exemplary status and information display is shown in FIG. 2. The various components described above may employ designs and construction now known or later developed.

Although FIG. 1 shows the electrical connections between the CPUs and the sensors and controls as wired connections, wireless transmission may be used instead or a combination thereof to send and receive sensed data and control information. It should be understood that although memory devices, interface circuits, analog-to-digital circuits, digital-to-analog circuits, and other devices known in the art are not explicitly shown in FIG. 1 or described herein, such circuits and devices are included in the system 10 where required or appropriate to carry out the method shown in FIG. 3 and described below.

Figure 3:
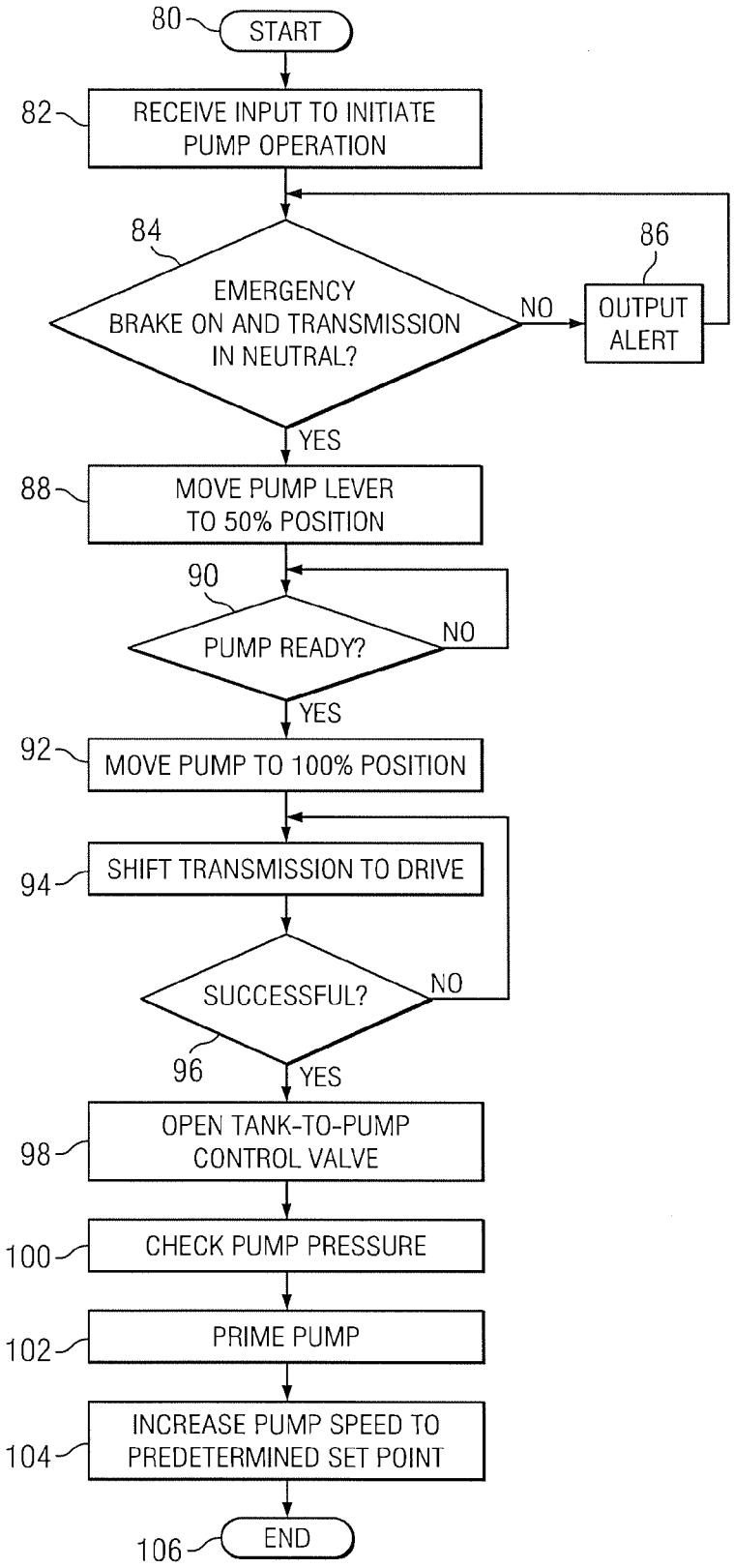
FIG. 3 is a simplified flowchart of an exemplary method of automatic pump operation generally for firefighting applications.

FIG. 3 is a simplified flowchart of an exemplary method 80 of automatic pump operation generally for firefighting applications. The method 80 may be implemented in computer software code specifying logic and operations which are carried out in series of steps. In block 82, the operator may initiate operations by using the master system control switch 66. Prior to initiating pump operations, the fire truck must first be stopped, the transmission shifted to neutral, and the emergency (parking) brake on. The operator may then initiate the operations using the control switch 66. In block 84, a determination may be made by the main CPU 50 whether the transmission is in neutral and the emergency brake is on. The determination may be made by the transmission CPU 54 and a brake sensor (not shown) and relayed to the main CPU 50. If these conditions are not satisfied, then an alert may be automatically generated and issued in block 86, such as issuing an audio alert to remind the operator that the transmission and brake conditions are not satisfied. Additionally, appropriate alert messages may be displayed on the display panel 72. The method does not proceed unless the transmission is placed in neutral and the emergency brake is engaged. If these conditions are satisfied, then in block 88 the pump control 60 is automatically moved to the 50% position, and in block 90 wait for confirmation. If the pump is properly put in the 50% setting, then the pump control 60 is automatically advanced to the 100% position in block 92. The transmission 14 is then automatically shifted to drive in block 94. If the transmission is in drive, as determined in block 96, then the tank-to-pump control valve 36 is opened in block 98. The pump discharge pressure is automatically obtained to determine whether it is operating properly in block 100. For example, it is desirable that the pump pressure is greater than 15 psi for most pump governors. In block 102, the prime pump 26 may be used to automatically prime the pump, if required or preferred. In block 104, the pump speed is automatically ramped up by increasing the engine speed to increase the pump discharge pressure. The pump speed may be raised so that the pump pressure reaches a predetermined pressure setting, for example. The automatic pump operation process ends in block 106.

In an alternate embodiment, the operator controls or interfaces 56, 60, and 28, of the transmission 14, pump 20, and prime pump 26 may each include an indicator 58, 62, and 30. The indicator 58, 62, and 30 may each be one or more visual indicators such as LEDs (light emitting diodes) and/or other lighting devices now known or later developed. The LEDs may also be color-coded to indicate proper operation/success or improper operation/failure. As the automatic pump operation proceeds through the steps, the indicator LEDs would be lit to alert the operator that the next steps in the sequence is to move or activate certain controls, levers, buttons, switches, etc. In this manner, the operator is instructed to proceed to the next step when appropriate in the correct sequence of steps using visual indicators. As described above, audio indicators or alerts may be used in combination with the visual indicators or instead thereof to provide instructions to the operator in the proper sequence of steps to operate the pump.

Accordingly, the disclosed method automatically steps through the proper sequence to put the fire truck in proper pump operation. The operator may be instructed using visual or audio cues as to the next step in the sequence. Alternatively, the system proceeds through the proper sequence automatically, requiring very little operator effort. In this manner, the truck is automatically put into successful pump operation without undue delay.

It should be noted that the word "water" is used herein to generally convey the concept of a fluid used for firefighting purposes, and "water" may include water, foam, chemicals, and other types of fire-suppression fluids.

Further notice should be given regarding the actual implementation of the system in that certain changes and modifications to the described system, though not described explicitly or in detail, are contemplated herein. For example, the main CPU, engine CPU, and transmission CPU may be implemented using one or more CPU circuits, controllers, or micro-controller circuits. Further, it is understood that a CPU is typically in operation with its attendant circuitry and software, such as memory, interfaces, drivers, etc. as known in the art.

The features of the present invention which are believed to be novel are set forth below with particularity in the appended claims. However, modifications, variations, and changes to the exemplary embodiments described above will be apparent to those skilled in the art, and the system and method of automatic pump operation for firefighting applications described herein thus encompasses such modifications, variations, and changes and are not limited to the specific embodiments described herein.

What is claimed is:

1. A system for automatically setting up a truck-mounted pump driven by an engine for pumping operation, comprising:

a transmission control having a visual indicator and coupled to a transmission of the truck;

a pump control having a visual indicator and coupled to the pump;

a plurality of visual indicators each associated with a particular vehicular control lever configured to set at least one of the pump, transmission, and brakes;

a master system control switch operable to receive operator input; and a main controller in data communication with the transmission control, the pump control, and the master system control switch, the main controller receiving an input from the master system control switch to initiate a pump setup operation, and automatically transmitting alert signals to the visual indicators of the transmission control, and pump control, to provide visual guidance to an operator in the proper sequence of steps to prepare the vehicle for proper pumping operation by turning on/off the visual indicators in a proper sequence of pump setup operations, the main controller is operable to determine a set of vehicular conditions including the truck is stopped, its transmission is in neutral, and the emergency brake is on, prior to initiating pump setup operation.

2. The system of claim 1, further comprising a prime control having a visual indicator and coupled to a prime pump.

3. The system of claim 1, wherein the visual indicators comprises lights.

4. The system of claim 1, wherein the visual indicators comprises light emitting diodes.

5. The system of claim 1, wherein the visual indicators comprises a display panel.

6. The system of claim 1, further comprising an audio control unit operable to automatically generate and issue audio alerts to provide audio guidance to the operator in the proper sequence of steps to set up the pump for proper pumping operation.

7. A vehicle-mounted pump, comprising:

a transmission control having a first visual indicator and coupled to a transmission of the vehicle;

a pump control having a second visual indicator and coupled to the pump;

a prime control having a third visual indicator and coupled to a prime pump;

first, second, and third visual indicators each associated with a particular vehicular control lever configured to operate the pump, transmission, and prime control;

a master system control switch operable to receive operator input; and a main controller in data communication with the transmission control, the pump control, the prime control, and the master system control switch, the main controller receiving an input from the master system control switch to initiate a pump setup operation, the main controller is operable to determine that the vehicle is stopped, its transmission is in neutral, and the emergency brake is on prior to initiating a pump setup operation, and automatically transmitting signals to the first, second, and third visual indicators of the transmission control, pump control, and prime control in a proper sequence of pump setup operations to provide visual guidance to an operator to follow the proper sequence of steps to operate the pump, the transmission, and the prime control, to set up the pump for proper pumping operation.

8. The system of claim 1, wherein the main controller is configured to:

receive an operator input to initiate pump setup operations;

output an alert in response to the set of vehicular conditions not being met;

automatically set the pump at about 50% operation and wait for confirmation of setting;

in response to the pump being set at about 50% operation, automatically set the pump at 100% operation;

automatically set a transmission of the truck in drive and wait for confirmation of setting;

in response to the transmission being set in drive, automatically open a pump control valve and check the pump pressure;

automatically prime the pump; and automatically increase an engine speed and a pump speed to predetermined settings to increase water flow from the pump.

9. The system of claim 1, wherein the main controller is configured to:

receive an operator input to initiate pump setup operations;

automatically output an alert in response to the set of vehicular conditions not being met;

automatically issuing an alert to guide the operator to set the pump at about 50% operation and wait for confirmation of setting;

in response to the pump being set at about 50% operation, automatically issuing an alert to guide the operator to set the pump at 100% operation;

automatically issuing an alert to guide the operator to set a transmission of the truck in drive and wait for confirmation of setting;

in response to the transmission being set in drive, automatically open a pump control valve and check the pump pressure;

automatically prime the pump; and automatically increase an engine speed and a pump speed to predetermined settings to increase water flow from the pump.

* * * * *